US012264115B2

(12) United States Patent
Lund et al.

(10) Patent No.: US 12,264,115 B2
(45) Date of Patent: Apr. 1, 2025

(54) IGNITION BOOSTER COMPOSITIONS AND METHODS OF MAKING THE SAME

(71) Applicant: AUTOLIV ASP, INC., Ogden, UT (US)

(72) Inventors: Gary K. Lund, Malad City, ID (US); Ivan V. Mendenhall, Providence, UT (US)

(73) Assignee: Autoliv ASP, Inc., Ogden, UT (US)

( * ) Notice: Subject to any disclaimer, the term of this patent is extended or adjusted under 35 U.S.C. 154(b) by 1169 days.

(21) Appl. No.: 16/530,042

(22) Filed: Aug. 2, 2019

(65) Prior Publication Data

US 2021/0032180 A1 Feb. 4, 2021

(51) Int. Cl.

| | |
|---|---|
| ***C06B 33/02*** | (2006.01) |
| ***C06B 21/00*** | (2006.01) |
| ***C06B 45/08*** | (2006.01) |

(52) U.S. Cl.

CPC ..... *C06B 33/02* (2013.01); *C06B 21/0041* (2013.01); *C06B 45/08* (2013.01)

(58) Field of Classification Search

None

See application file for complete search history.

(56) References Cited

U.S. PATENT DOCUMENTS

| | | | | |
|---|---|---|---|---|
| 5,936,195 | A * | 8/1999 | Wheatley | C06D 5/06 149/46 |
| 6,077,372 | A | 6/2000 | Mendenhall et al. | |
| 6,132,537 | A | 10/2000 | Zeuner et al. | |
| 6,241,281 | B1 * | 6/2001 | Hinshaw | C06D 5/06 280/741 |
| 7,758,709 | B2 | 7/2010 | Hussey et al. | |
| 8,057,610 | B2 | 11/2011 | Hussey et al. | |
| 8,388,777 | B2 | 3/2013 | Barnes et al. | |
| 8,657,333 | B2 | 2/2014 | Young et al. | |
| 8,815,029 | B2 | 8/2014 | Lund et al. | |
| 8,980,023 | B2 | 3/2015 | Lund | |
| 9,193,639 | B2 | 11/2015 | Bradford et al. | |
| 2002/0033211 | A1 | 3/2002 | Zeuner et al. | |
| 2004/0134576 | A1 * | 7/2004 | Taylor | C06C 9/00 149/22 |
| 2006/0219340 | A1 * | 10/2006 | Dunham | C06B 23/007 149/19.7 |
| 2009/0044886 | A1 | 2/2009 | Brisighella et al. | |
| 2009/0159163 | A1 * | 6/2009 | Sasamoto | C06C 9/00 149/75 |
| 2014/0261927 | A1 | 9/2014 | Mendenhall et al. | |
| 2014/0261929 | A1 | 9/2014 | Mendenhall | |
| 2017/0267601 | A1 * | 9/2017 | Reimer | C06B 21/0025 |
| 2022/0055966 | A1 * | 2/2022 | Luo | C06B 21/0008 |

FOREIGN PATENT DOCUMENTS

| | | | |
|---|---|---|---|
| CN | 110317120 | * | 5/2019 |

OTHER PUBLICATIONS

International Search Report & Written Opinion received for the PCT Application No. PCT/US2020/044135, mailed on Nov. 4, 2020, 12 pages.

* cited by examiner

*Primary Examiner* — Aileen B Felton

(74) *Attorney, Agent, or Firm* — Harness, Dickey & Pierce, P.L.C.; Stephen T. Olson

(57) ABSTRACT

An igniter composition has (i) a source of copper selected from basic copper nitrate, copper oxide, copper hydroxide, and/or copper complex of guanylurea nitrate, (ii) one or more oxidizers, (iii) a binder selected from guanidine nitrate and/or guanylurea nitrate, and (iv) an inorganic fuel comprising an elemental metal or metal hydride selected from the group consisting of: titanium, silicon, aluminum, magnesium, iron, and combinations thereof. The igniter composition may be substantially free of boron or contain minimal amounts of boron. A minimum flame temperature at combustion ($T_c$) of ≥about 2300K (2,027° C.). Such a mixture may be spray dried to form a powder that is compacted to form a solid igniter composition, such as a pellet or grain. The mixture that is spray dried may have a heat of explosion (HEX) of ≤about 1,000 calories per gram (cal/g). Inorganic fuel can then be added to the spray-dried powder.

17 Claims, No Drawings

IGNITION BOOSTER COMPOSITIONS AND METHODS OF MAKING THE SAME

BACKGROUND

This section provides background information related to the present disclosure which is not necessarily prior art.

Pyrotechnic materials are used in passive restraint systems, including in inflators for airbag modules. Examples of such pyrotechnic materials include ignition booster compositions (also referred to as igniter, initiator, and/or booster compositions), as well as conventional gas generants. A gas generant material burns to produce the majority of gas products that are directed to an airbag to provide inflation. Airbag modules employing gas generants often use a squib or initiator which is electrically ignited when rapid deceleration and/or collision is sensed. The discharge from the squib/initiator can ignite an igniter or ignition material that burns rapidly and exothermically, in turn, igniting the gas generant material. Often, the initiator may include several stages that may employ one or more igniter or ignition booster compositions.

Ignition booster materials are traditionally based on pyrotechnic formulations containing elemental boron as the sole or primary fuel. Such compositions feature rapid combustion, ease of ignition, high flame temperatures and effective transfer of energy to an acceptor composition such as a main gas generator charge. These same desirable properties unfortunately can require significant care in the preparation and storage of these materials, which can make them expensive to produce. Such materials combust extremely rapidly at ambient pressure. From a flash burn perspective, this limits the amount of material that may be processed at one time, which makes production of these compositions labor intensive. Additionally, boron is a relatively expensive raw material. Consequently, it would be desirable to develop effective ignition booster compositions that are relatively safe to handle and produce for use in automotive and other pyrotechnic devices.

SUMMARY

This section provides a general summary of the disclosure, and is not a comprehensive disclosure of its full scope or all of its features.

The present disclosure provides in certain variations an igniter composition that comprises:

(i) a source of copper selected from the group consisting of: basic copper nitrate, copper oxide, copper hydroxide, copper complex of guanylurea nitrate, and combinations thereof;

(ii) one or more oxidizers;

(iii) a binder selected from the group consisting of: guanidine nitrate guanylurea nitrate, and combinations thereof; and (iv) an inorganic fuel comprising an elemental metal or metal hydride comprising a metal selected from the group consisting of: titanium, silicon, aluminum, magnesium, iron, and combinations thereof.

In one aspect, the inorganic fuel is selected from the group consisting of: titanium hydride, titanium, silicon, aluminum, and combinations thereof.

In one aspect, the igniter composition is substantially free of boron.

In one aspect, the igniter composition further comprises less than or equal to about 3 weight % of boron or a compound comprising boron.

In one aspect, the igniter composition further comprises at least one organic fuel comprising dicyandiamide (DCDA).

In one aspect, the igniter composition has a minimum flame temperature at combustion ($T_c$) of greater than or equal to about 2300K (2,027° C.).

In one aspect, (i) the source of copper is present at greater than or equal to about 2% to less than or equal to about 20% by weight of the total igniter composition; (ii) a total amount of the one or more oxidizers is greater than or equal to about 20% to less than or equal to about 60% by weight of the total igniter composition; (iii) the binder is present at greater than or equal to about 14% to less than or equal to about 60% by weight of the total igniter composition; and (iv) the inorganic fuel is present at greater than or equal to about 2% to less than or equal to about 15% by weight of the total igniter composition.

In one aspect, (i) the source of copper is present at greater than or equal to about 4% to less than or equal to about 17% by weight of the total igniter composition; (ii) a total amount of the one or more oxidizers is greater than or equal to about 5% to less than or equal to about 40% by weight of the total igniter composition; (iii) the binder is present at greater than or equal to about 14% to less than or equal to about 40% by weight of the total igniter composition; and (iv) the inorganic fuel is present at greater than or equal to about 4% to less than or equal to about 12% by weight of the total igniter composition.

In one aspect, the one or more oxidizers are selected from the group consisting of: alkali metal or alkaline earth metal nitrates, alkali metal, alkaline earth metal, or ammonium perchlorates, and combinations thereof and a total amount of the one or more oxidizers present in the igniter composition is greater than or equal to about 20% to less than or equal to about 60% by weight of the total igniter composition.

The present disclosure provides also provides an igniter composition in certain other variations that comprises:

(i) basic copper nitrate present at greater than or equal to about 4% to less than or equal to about 17% by weight of the total igniter composition;

(ii) one or more oxidizers selected from the group consisting of: potassium perchlorate ($KClO_4$), strontium nitrate ($Sr(NO_3)_2$), potassium nitrate ($KNO_3$), and combinations thereof, wherein a total amount of the one or more oxidizers is greater than or equal to about 20% to less than or equal to about 60% by weight of the total igniter composition;

(iii) guanidine nitrate present at greater than or equal to about 14% to less than or equal to about 60% by weight of the total igniter composition; and (iv) an inorganic fuel selected from the group consisting of: titanium hydride, titanium, silicon, aluminum, and combinations thereof present at greater than or equal to about 2% to less than or equal to about 15% by weight of the total igniter composition.

In one aspect, the igniter composition is substantially free of boron.

In one aspect, the igniter composition further comprises less than or equal to about 3 weight % of boron or a compound comprising boron.

In one aspect, the igniter composition has a minimum flame temperature at combustion ($T_c$) of greater than or equal to about 2300K (2,027° C.).

In yet other variations, the present disclosure provides a method for forming an igniter composition. The method comprises mixing (i) a source of copper selected from the group consisting of: basic copper nitrate, copper oxide, copper hydroxide, copper complex of guanylurea nitrate, and combinations thereof, (ii) one or more oxidizers, and (iii) a binder selected from the group consisting of: guanidine nitrate guanylurea nitrate, and combinations thereof together in a liquid to form a mixture having a heat of explosion (HEX) of less than or equal to about 1,000 calories per gram (cal/g). The mixture is spray dried to form a powder. The method also comprises compacting the powder to form a solid igniter composition.

In one aspect, the mixing further comprises mixing (iv) an inorganic fuel comprising an elemental metal or metal hydride comprising a metal selected from the group consisting of: titanium, silicon, aluminum, magnesium, iron, and combinations thereof into the liquid.

In one aspect, (i) the source of copper is present at greater than or equal to about 2% to less than or equal to about 20% by weight of the total igniter composition; (ii) each of the one or more oxidizers is present at greater than or equal to about 1% to less than or equal to about 55% by weight of the total igniter composition; (iii) the binder is present at greater than or equal to about 14% to less than or equal to about 60% by weight of the total igniter composition; and (iv) the inorganic fuel is present at greater than or equal to about 2% to less than or equal to about 15% by weight of the total igniter composition.

In one aspect, after the spray drying, the method further comprises combining the powder with (iv) an inorganic fuel comprising an elemental metal or metal hydride comprising a metal selected from the group consisting of: titanium, silicon, aluminum, magnesium, iron, and combinations thereof.

In one further aspect, (i) the source of copper is present at greater than or equal to about 2% to less than or equal to about 20% by weight of the total solid igniter composition;

(ii) a total amount of the one or more oxidizers is greater than or equal to about 20% to less than or equal to about 60% by weight of the total solid igniter composition;

(iii) the binder is present at greater than or equal to about 14% to less than or equal to about 60% by weight of the solid total igniter composition; and (iv) the inorganic fuel is present at greater than or equal to about 2% to less than or equal to about 15% by weight of the total solid igniter composition.

In one aspect, the solid igniter composition comprises:

(i) the source of copper comprises basic copper nitrate present at greater than or equal to about 4% to less than or equal to about 17% by weight of the total solid igniter composition;

(ii) the one or more oxidizers are selected from the group consisting of: potassium nitrate, strontium nitrate, potassium perchlorate, and combinations thereof, wherein a total amount of the one or more oxidizers is greater than or equal to about 20% to less than or equal to about 60% by weight of the total solid igniter composition;

(iii) the binder comprises guanidine nitrate present at greater than or equal to about 14% to less than or equal to about 60% by weight of the total solid igniter composition; and the solid igniter composition further comprises:

(iv) an inorganic fuel is selected from the group consisting of: titanium hydride, silicon, aluminum, titanium, and combinations thereof present at greater than or equal to about 2% to less than or equal to about 15% by weight of the total solid igniter composition.

Further areas of applicability will become apparent from the description provided herein. The description and specific examples in this summary are intended for purposes of illustration only and are not intended to limit the scope of the present disclosure.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

As used herein, the terms "composition" and "material" are used interchangeably to refer broadly to a substance containing at least the desired chemical constituents, elements, or compounds, but which may also comprise additional elements, compounds, or substances, including trace amounts of impurities, unless otherwise indicated.

As used herein, unless otherwise indicated, amounts expressed in weight and mass are used interchangeably, but should be understood to reflect a mass of a given component.

Example embodiments will now be described more fully with reference to the accompanying drawings.

The present disclosure provides an igniter composition, which may also be referred to as an initiator composition or a booster composition. In certain variations, such an igniter composition provides one or more of the following advantages: rapid combustion, ease of ignition, high combustion flame temperatures, efficient combustion at low pressures, and/or effective transfer of energy to an acceptor composition, for example, the main gas generant material, as will be described further below. It is understood that while general attributes of each of the above categories of components may differ, there may be some common attributes and any given material may serve multiple purposes within two or more of such listed classes or categories. For example, as will be described further herein, a source of copper may be basic copper nitrate that assists with transferring energy to the gas generant; however, may also serve as an oxidizer in the igniter composition.

In various aspects, the igniter compositions provided in accordance with the present disclosure serve as effective ignition booster compositions, which are relatively safe to handle and produce for use in automotive and other pyrotechnic devices. Such igniter compositions can be handled and processed in a manner more similar to those of conventional gas generants, rather than more sensitive conventional igniter compositions that typically comprise large amounts of boron as a fuel.

The igniter composition comprises (i) a source of copper. The source of copper provides copper in the combustion products of the igniter composition after ignition, which can be desirable for transfer of ignition energy to a main gas generant charge or material. In certain variations, the source of copper is basic copper nitrate (bCN), which can also serve as an oxidant. Other stable copper compounds contemplated for use in certain variations of the igniter composition, include copper oxide (CuO) or copper hydroxide ($Cu(OH)_2$), which can serve the same function of providing copper in combustion products for energy transfer, although these compounds may not be as effective as an oxidizer with respect to reactivity and burn rates in an igniter composition in the same manner as basic copper nitrate. Furthermore, the selection of the source of copper may depend upon the fuel used. For example, where dicyandiamide (DCDA) is used as an organic fuel, generally copper oxide (CuO) or copper hydroxide ($Cu(OH)_2$) may be omitted from the formulation, because these can lead to undesirable side reactions that form a copper complex of guanylurea nitrate (CuGUN). In other variations, the source of copper may be a copper complex of guanylurea nitrate (CuGUN), more specifically referred to as copper II bis guanylurea dinitrate. Thus, in embodiments where dicyandiamide (DCDA) is used as an organic fuel, the copper source may be a copper complex of guanylurea nitrate (CuGUN), as no further reaction with DCDA will occur. In certain variations, the (i) source of copper is selected from the group consisting of: basic copper nitrate, copper oxide, copper hydroxide, copper complex of guanylurea nitrate, and combinations thereof. In other variations, the (i) source of copper is selected from the group consisting of: basic copper nitrate, copper oxide, copper hydroxide, and combinations thereof. In yet other variations, the (i) source of copper comprises basic copper nitrate.

The (i) source of copper may be present in the igniter composition in an amount of greater than or equal to about 2% to less than or equal to about 20% by weight of the igniter composition; optionally greater than or equal to about 3% to less than or equal to about 18% by weight; and in certain variations, optionally greater than or equal to about 4% to less than or equal to about 17% by weight.

The igniter composition also comprises (ii) at least one oxidizer in addition to the (i) source of copper. In certain variations, the igniter composition comprises a combination of multiple oxidizers, for example, such that the oxidizers may be nominally considered a primary oxidizer, a second oxidizer, and the like. One or more oxidizers are selected along with a hot burning inorganic fuel component to form an igniter material that upon combustion achieves an effectively high burn rate and energy transfer to a gas generant material.

Suitable oxidizers for the igniter composition of the present disclosure generally include, by way of non-limiting example, alkali metal (e.g., elements of Group 1 of IUPAC Periodic Table, including Li, Na, K, Rb, and/or Cs), alkaline earth metal (e.g., elements of Group 2 of IUPAC Periodic Table, including Be, Ng, Ca, Sr, and/or Ba), and ammonium nitrates, nitrites, and perchlorates; metal oxides (including Cu, Mo, Fe, Bi, La, and the like); basic metal nitrates (e.g., elements of transition metals of Row 4 of IUPAC Periodic Table, including Mn, Fe, Co, Cu, and/or Zn); transition metal complexes of ammonium nitrate (e.g., elements selected from Groups 3-12 of the IUPAC Periodic Table); metal ammine nitrates, metal hydroxides, and combinations thereof. In igniter compositions where select fuels are included, it may be advantageous to avoid certain oxidizers. For example, as discussed above, when dicyandiamide (DCDA) is employed in the igniter composition, conventional metal oxides, like copper oxide (CuO), conventional hydroxides, like copper hydroxide ($Cu(OH)_2$), and basic metal nitrates, like basic copper nitrate, may be omitted from the igniter composition to avoid undesired side reactions, for example, to unintentionally form a copper complex of guanylurea nitrate (CuGUN).

In certain variations, (ii) an oxidizer in the igniter composition may be selected from the group consisting of: alkali metal, alkaline earth metal, and ammonium nitrates and perchlorates. For example, one or more (ii) oxidizers may be selected from the group consisting of: potassium perchlorate ($KClO_4$, also referred to nominally as KP), strontium nitrate ($Sr(NO_3)_2$), potassium nitrate ($KNO_3$), and combinations thereof. In certain variations, the oxidizers may include potassium perchlorate (KP) and either strontium nitrate or potassium nitrate or both. In such an embodiment, this combination of oxidizers provides for good reactivity based on inclusion of the potassium perchlorate and advantageous reduction in handling sensitivity to moisture due to the presence of the nitrate-containing oxidizer. In certain aspects, potassium nitrate is employed as the nitrate oxidizer, because it has low moisture sensitivity and does not impart moisture sensitivity to the final igniter composition. As noted above, in certain variations, the basic copper nitrate may serve as both (i) a source of copper and (ii) an oxidizer in the igniter composition.

Therefore, the igniter composition may comprise basic copper nitrate along with one or more (ii) oxidizers selected from the group consisting of alkali metal nitrates, alkaline earth metal nitrates, ammonium nitrates, alkali metal perchlorates, alkaline earth metal perchlorates, ammonium perchlorates, and combinations thereof. The basic copper nitrate may be provided in amounts indicated above.

Individual oxidizing agents may be respectively present in an igniter composition in an amount of greater than or equal to about 1% to less than or equal to about 55% by weight of the igniter composition; optionally greater than or equal to about 3% to less than or equal to about 50% by weight; optionally greater than or equal to about 5% to less than or equal to about 40% by weight; optionally greater than or equal to about 5% to less than or equal to about 30% by weight; and in certain aspects, greater than or equal to about 10% to less than or equal to about 25% by weight of the igniter composition. In certain variations, the cumulative total amount of all (ii) oxidizer(s) in the igniter composition, exclusive of the (i) source of copper may be greater than or equal to about 20% by weight to less than or equal to about 60% by weight of the igniter composition, optionally greater than or equal to about 30% to less than or equal to about 60% by weight of the igniter composition, or optionally greater than or equal to about 30% by weight to less than or equal to about 55% by weight of the igniter composition. In other variations, a cumulative total amount of all (ii) oxidizer(s) in the igniter composition including the (i) source of copper (e.g., basic copper nitrate) may be greater than or equal to about 40% by weight to less than or equal to about 62% by weight of the igniter composition, or optionally greater than or equal to about 30% to less than or equal to about 60% by weight of the igniter composition.

In various aspects, the igniter compositions according to certain aspects of the present disclosure also comprise iii) a binder. Binders are commonly used in pyrotechnic compositions to increase adhesion/bonding to retain the shape of the various igniter solid components, particularly when they are formed via extrusion and/or molding, and to prevent fracture during storage and use. Typically, igniter compositions are not capable of being tableted or formed into pellets due to the sensitivity of the raw materials, especially due to the presence of boron-containing fuel compounds. However, as described further below, the present disclosure contemplates methods of making igniter compositions that may be in the form of tablets, pellets, or grains and thus include binders appropriate for an igniter composition (for example, having a high burn rate to maintain effective ballistic properties for an igniter). Binders used in an igniter composition may have some fuel value (and may be considered to be a fuel in a conventional gas generant) and thus may be considered to be a co-fuel, but such binders generally do not have a high enough burn rate to serve as a primary fuel in an igniter composition that requires a high burn rate and rapid reaction. Thus, in certain variations, a dry blended mixture of various pyrotechnic components can be mixed with a liquid binder and then may be extruded. Alternatively, solid binder particles can be dissolved in a solvent or heated to the melting point, then mixed with other pyrotechnic components and extruded or molded. In accordance with certain variations of the present disclosure, binders may contribute to the igniter composition as a slower burning fuel. Suitable (iii) binders in accordance with the present disclosure may be selected from the group consisting of guanidine nitrate, guanylurea nitrate (GUN), and combinations thereof. Where the binder comprises guanylurea nitrate (GUN), the (i) source of copper may be a copper complex of guanylurea nitrate (CuGUN), which can avoid undesirable side reactions. In one aspect, the (iii) binder comprises only guanidine nitrate (GN).

Binders may be present in an igniter composition according to certain aspects of the present disclosure in an amount of greater than or equal to about 10% to less than or equal to about 60% by weight of the igniter composition; optionally greater than or equal to about 10% to less than or equal to about 50% by weight; optionally greater than or equal to about 14% to less than or equal to about 60% by weight; and in certain aspects, optionally greater than or equal to about 14% to less than or equal to about 40% by weight of the igniter composition. In certain alternate aspects, the binder may be present at greater than or equal to about 23% to less than or equal to about 60% by weight of the igniter composition.

In other variations, the igniter composition comprises (iv) at least one inorganic fuel that is a hot burning fuel. The inorganic fuel comprises an elemental metal or metal hydride. The metal is selected from the group consisting of: titanium (Ti), silicon (Si), aluminum (Al), magnesium (Mg), iron (Fe), and combinations thereof. A hot burning fuel may be considered to be one having a maximum flame temperature at combustion ($T_c$) of greater than or equal to about 2500K (2,227° C.). In certain variations, the igniter composition comprises at least one inorganic fuel selected from the group consisting of: titanium hydride ($TiH_2$), elemental silicon (Si), elemental aluminum (Al), elemental titanium (Ti), and combinations thereof. In certain aspects, the igniter composition comprises titanium hydride ($TiH_2$).

The use of less aggressive inorganic fuels relative to boron, such as $TiH_2$, Si or Al, by way of non-limiting example, also results in a less brisant combustion and a higher gas production. Brisance is generally understood to be the propensity of a given material to react in mass or an expression of the violence of the reaction. The reduction in brisance in the igniter compositions provided by the present disclosure help reduce damage to the acceptor gas generant charge and the increase in gas production helps pressurize the inflator combustion chamber resulting in enhanced ignition performance.

In certain variations, the (iv) inorganic fuel may be present in the igniter composition in an amount of greater than or equal to about 2% to less than or equal to about 15% by weight of the igniter composition; optionally greater than or equal to about 3% to less than or equal to about 13% by weight; and in certain aspects, optionally greater than or equal to about 4% to less than or equal to about 12% by weight of the igniter composition.

In certain variations, the initiator composition may further comprise (v) at least one hot burning organic fuel comprising dicyandiamide (DCDA). As noted above, when the dicyandiamide (DCDA) is used as the hot burning organic fuel in the igniter composition, the copper source may be a copper complex of guanylurea nitrate (CuGUN), so that no further side reactions with DCDA occur. The (v) hot burning organic fuel may be present in the igniter composition in an amount of greater than or equal to about 5% to less than or equal to about 13% by weight of the igniter composition; optionally greater than or equal to about 7% to less than or equal to about 11% by weight; and in certain aspects, greater than or equal to about 8% to less than or equal to about 10% by weight of the igniter composition.

In certain variations, the igniter compositions may be substantially free of boron or boron-containing compounds. The term "substantially free" as referred to herein is intended to mean that the boron-containing compound or species is absent to the extent that undesirable and/or detrimental properties associated with the presence of boron (for example, flammability and sensitivity during handling) are negligible or nonexistent. In certain aspects, an igniter composition that is "substantially free" of such boron-containing compounds comprises less than or equal to about 0.5% by weight, optionally less than or equal to about 0.1% by weight, and in certain aspects, 0% by weight of the undesired boron-containing compound.

In certain other aspects, the igniter composition may include minor amounts of a boron fuel to the extent that the igniter composition properties are not detrimentally affected. For example, in alternative variations, boron may be utilized, but it is desirable to limit the amount in the igniter formulation so as to not make the composition overly sensitive and aggressive to casual ignition. If boron or boron-containing compounds are present, they may be present in relatively small amounts. For example, boron or boron-containing compounds may be present at less than or equal to about 3% by weight of the total igniter composition. If boron or boron-containing compounds are present in the igniter material, it is desirable such that the brisance of the material is relatively low. For example, in certain variations, the igniter composition comprising boron may have a relatively low brisance where an open air burn rate for the igniter composition is less than or equal to about 2 mm per second at a pressure of about 14 psi when the boron-containing material is present at less than about 3% by weight of the total igniter composition. In other variations, the igniter composition comprising boron may have a relatively low brisance, for example, where an impact sensitivity may be greater than or equal to about 4 inches (about 10.2 cm) or any of the values discussed further below. By way of example, a boron-containing material may be present in certain embodiments at greater than or equal to about 0.1% to less than or equal to about 3% by weight; and optionally greater than or equal to about 0.5 to less than or equal to about 2% by weight of the igniter composition.

In certain variations of the present disclosure, the igniter composition comprises (i) a source of copper selected from the group consisting of: basic copper nitrate, copper oxide, copper hydroxide, copper complex of guanylurea nitrate, and combinations thereof at greater than or equal to about 2% to less than or equal to about 20% by weight of the igniter composition or optionally greater than or equal to about 4% to less than or equal to about 17% by weight of the igniter composition. The igniter composition may further include (ii) at least one oxidizer (for example, where basic copper nitrate is present as the (i) source of copper above combined with one of more additional oxidizers), where the one or more additional oxidizers are respectively present at greater than or equal to about 1% to less than or equal to about 55% by weight of the total igniter composition, optionally present at greater than or equal to about 3% to less than or equal to about 50% by weight of the total igniter composition. Where basic copper nitrate is present as the (i) source of copper above with one of more additional oxidizers, the additional oxidizers, such as a perchlorate or nitrate, may be present at an amount of greater than or equal to about 20% by weight to less than or equal to about 60% by weight of the total igniter composition, optionally greater than or equal to about 30% by weight to less than or equal to about 60% by weight, or optionally greater than or equal to about 30% by weight to less than or equal to about 55% by weight of the igniter composition. In certain aspects, a total amount of all (ii) oxidizer(s) in the igniter composition, inclusive of the (i) source of copper (e.g., basic copper nitrate) may be greater than or equal to about 20% by weight to less than or equal to about 62% by weight of the igniter composition, and optionally greater than or equal to about 30% to less than or equal to about 60% by weight of the igniter composition.

In certain variations of the present disclosure, the igniter composition comprises (iii) a binder, such as guanidine nitrate and/or guanylurea nitrate, present at greater than or equal to about 14% to less than or equal to about 60% by weight of the igniter composition. In certain variations, the (iii) binder may be present at greater than or equal to about 14% to less than or equal to about 40% by weight of the igniter composition. In other variations, the (iii) binder may be present at greater than or equal to about 23% to less than or equal to about 60% by weight of the igniter composition.

In various aspects of the present disclosure, the igniter composition also comprises (iv) at least one inorganic fuel comprising an elemental metal or metal hydride, where the metal is selected from the group consisting of: titanium, silicon, aluminum, magnesium, iron, and combinations thereof. The inorganic fuel is present at greater than or equal to about 2% to less than or equal to about 15% by weight of the igniter composition.

In certain alternative variations of the present disclosure, the igniter composition also comprises (v) at least one organic fuel comprising dicyandiamide (DCDA) present at greater than or equal to about 5% to less than or equal to about 13% by weight of the igniter composition.

The igniter composition may also include other suitable pyrotechnic additives known to those of skill in the art in minor amounts, such as pressing aids, anticaking agents, slagging agents, dispersing aids, flow aids, viscosity modifiers, phlegmatizing agents, and the like. Generally, such pyrotechnic additives may be respectively included in the igniter composition in an amount of greater than 0 to less than or equal to about 5 weight %.

In one variation, the igniter composition may comprise (i) the source of copper present at greater than or equal to about 4% to less than or equal to about 17% by weight of the total igniter composition, (ii) the one or more oxidizers (exclusive of the source of copper (i)) are present in a total amount of greater than or equal to about 20% to less than or equal to about 60% by weight of the total igniter composition, (iii) the binder is present at greater than or equal to about 14% to less than or equal to about 60% by weight of the total igniter composition, and the at least one inorganic fuel is present at greater than or equal to about 4% to less than or equal to about 12% by weight of the total igniter composition.

Such an igniter composition may be substantially free of boron. Alternatively, the igniter composition may comprise less than or equal to about 3 weight % of boron or a compound comprising boron. In certain other variations, such an igniter composition may further comprise an organic fuel comprising dicyandiamide (DCDA) or any of the pyrotechnic additives discussed previously above. Further, in certain variations, such an igniter composition may have one or more pyrotechnic additives discussed above.

In another variation, the present disclosure provides an igniter composition comprising (i) basic copper nitrate present at greater than or equal to about 4% to less than or equal to about 17% by weight of the total igniter composition. The igniter composition also comprises (ii) one or more oxidizers selected from the group consisting of: potassium perchlorate ($KClO_4$), strontium nitrate ($Sr(NO_3)_2$), potassium nitrate ($KNO_3$), and combinations thereof. A cumulative total amount of the one or more oxidizers (exclusive of the source of copper (i)) is greater than or equal to about 20% to less than or equal to about 60% by weight of the total igniter composition. The one of more oxidizers may comprise potassium perchlorate ($KClO_4$) as a first oxidizer and a second oxidizer selected from the group consisting of: strontium nitrate ($Sr(NO_3)_2$), potassium nitrate ($KNO_3$), and combinations thereof. The first oxidizer may be present at greater than or equal to about 20% by weight to less than or equal to about 30% by weight, for example at about 25% by weight. The second oxidizer may be present at greater than or equal to about 5% by weight to less than or equal to about 15% by weight, for example at about 10% by weight. The igniter composition also may comprise guanidine nitrate present at greater than or equal to about 14% to less than or equal to about 60% by weight of the total igniter composition. Further, the igniter composition may comprise at least one inorganic fuel selected from the group consisting of: titanium hydride, silicon, aluminum, titanium, and combinations thereof. The inorganic fuel is present at greater than or equal to about 2% to less than or equal to about 15% by weight of the total igniter composition.

Such an igniter composition may be substantially free of boron. Alternatively, the igniter composition may comprise less than or equal to about 3 weight % of boron or a compound comprising boron. In certain other variations, such an igniter composition may further comprise an organic fuel comprising dicyandiamide (DCDA) or any of the pyrotechnic additives discussed previously above. Further, in certain variations, such an igniter composition may have one or more pyrotechnic additives discussed above.

The igniter compositions of the present disclosure may be spray dried in normal production equipment (e.g., equipment used for producing conventional gas generants) either as a final composition or as a fuel-deficient precursor to which the desired inorganic fuel (or other fuels) is later incorporated by blending. The igniter composition has a response to ignition at ambient pressures that is relatively mild, being more similar to the properties associated with a gas generant rather than a conventional igniter composition. In this regard, the igniter compositions of the present disclosure are not restricted as to the quantity of material that may be processed and handled or the manner in which they are handled. This is particularly advantageous when employing a spray dry process to form precursors. In such a circumstance, the composition being processed according to various aspects of the present disclosure may have a heat of explosion (HEX) of less than or equal to about 1,000 calories per gram (cal/g), which is generally a maximum HEX permitted for safely conducting spray dry operations. In certain aspects, where the composition is being processed via spray drying, a heat of explosion (HEX) may be greater than or equal to about 700 cal/g to less than or equal to about 1,000 cal/g. In certain variations, after spray drying to form a powder (e.g., a fuel deficient igniter powder), one or more inorganic fuels or other components may be added to the spray-dried product, which may subsequently increase the heat of explosion (HEX) value above such levels.

In certain aspects, the igniter composition exhibits a minimum flame temperature at combustion ($T_c$) of greater than or equal to about 2300K (2,027° C.) and in certain aspects, optionally greater than or equal to about 2500K (2,227° C.).

As noted above, the igniter composition prepared in accordance with various aspects of the present disclosure may have advantageous safety properties including a reduced brisance. Further, advantageous safety properties may be reflected by way of example when the solid igniter material has a reduced impact sensitivity, reduced friction sensitivity, reduced electrostatic device (ESD) sensitivity and/or reduced open air linear burning rate as compared to a conventional ignition material containing boron at high levels, for example, in excess of 3% by weight. In certain aspects, a relatively low open air linear burning rate is particularly desirable, as it reflects a measure of the bulk hazard of the pyrotechnic material resulting from inadvertent ignition.

A linear burn rate "$r_b$" for a pyrotechnic material is independent of a surface area of the pyrotechnic material and can be expressed in length per time at a given pressure. The burn rate profile can also be characterized to find the burn rate constant and slope of burn rate $r_b=k(P)^n$, where $r_b$=burn rate (linear); k=is a constant and P=pressure and n=a pressure exponent, where the pressure exponent is the slope of a linear regression line drawn through a log-log plot of burn rate ($r_b$) versus pressure (P). In accordance with various aspects of the present disclosure, the igniter composition has an open air linear burn rate of less than or equal to about 3.5 mm per second at a standard atmospheric pressure of about 14 pounds per square inch (psi) (0.1 MPa). In certain embodiments, the burn rate for the igniter composition is less than or equal to about 3 mm per second at a pressure of about 14 psi (0.1 MPa), optionally less than or equal to about 2.5 mm per second at a pressure of about 14 psi (0.1 MPa), optionally less than or equal to about 2 mm per second at a pressure of about 14 psi (0.1 MPa), optionally less than or equal to about 1.5 mm per second at a pressure of about 14 psi (0.1 MPa), optionally less than or equal to about 1 mm per second at a pressure of about 14 psi (0.1 MPa), optionally less than or equal to about 0.5 mm per second at a pressure of about 14 psi (0.1 MPa), optionally less than or equal to about 0.25 mm per second at a pressure of about 14 psi (0.1 MPa), and in certain variations, there is no propagation, so that the linear burn rate is 0 mm per second at an atmospheric pressure of about 14 psi (0.1 MPa).

In certain aspects, the igniter composition exhibits a reduced impact sensitivity, for example, in certain variations, reflected by an impact sensitivity of greater than or equal to about 4 inches (about 10.2 cm). In certain variations, the reduced impact sensitivity may be greater than or equal to about 15 inches (about 38.1 cm), optionally greater than or equal to about 16 inches (about 40.6 cm), and in certain variations, greater than or equal to about 17 inches (about 43.2 cm). Impact sensitivity can be determined by use of a U.S. Bureau of Explosives (BOE) impact machine. A test used to measure the sensitiveness of a substance to drop-weight impact is described in the United Nations 2015 "Recommendations on the Transport of Dangerous Goods: Manual of Tests and Criteria," $6^{th}$ Revised Edition, the relevant portions of which are incorporated herein by reference.

The following procedure described in these United Nations Recommendations can be used to measure drop-weight impact sensitivity. A weight is dropped from predetermined heights and a sample observed to determine if a reaction has occurred. A reaction is considered to have occurred if a flame, smoke or audible report is observed. More specifically, a weight of mass 3.63 Kg falls between two parallel cylindrical guide rods from pre-selected heights, onto a plunger and plug assembly. This assembly is in contact with the sample, which in turn is placed on a die-and-anvil assembly and confined in a cylindrical casing. The inside diameter of the cylindrical casing is just sufficient to permit free movement of the plunger and slug. Generally, as discussed above, any sample that exhibits frequent reaction below 4 inches of drop height is considered to be too sensitive for practical use.

It should be noted that when ignited by the squib or initiator within the airbag module, the igniter composition desirably has a linear burn rate of greater than or equal to about 1.4 inches per second at 3,000 pounds per square inch (psi) (40.6 mm/s at 20.7 MPa). In certain embodiments, the burn rate for the igniter composition is greater than or equal to about 1.5 inches per second at a pressure of about 3,000 psi (43.8 mm/s at 20.7 MPa), optionally is greater than or equal to about 1.6 inches per second at a pressure of about 3,000 psi (43.8 mm/s at 20.7 MPa), optionally is greater than or equal to about 1.7 inches per second at a pressure of about 3,000 psi (43.8 mm/s at 20.7 MPa), optionally greater than or equal to about 1.8 inches per second at a pressure of about 3,000 psi (45.8 mm/s at 20.7 MPa), optionally less than or equal to about 1.9 inches per second at a pressure of about 3,000 psi (48.3 mm/s at 20.7 MPa), and in certain variations, optionally greater than or equal to about 2 inches per second at a pressure of about 3,000 psi (50.8 mm/s at 20.7 MPa).

The gas yield of the igniter compositions according to certain aspects of the present disclosure may be greater than or equal to about 2.5 moles/100 grams of igniter composition. In other embodiments, the gas yield is greater than or equal to about 2.6 moles/100 g of igniter composition.

In certain aspects, the igniter compositions provided in accordance with the present disclosure may be water soluble or capable of being processed by a slurry that can be spray dried to form solid granules or powder that may be formed into consolidated structures, like pellets. In certain aspects, an igniter body is formed from an igniter powder created by a spray drying process. In certain aspects, a mixture includes a (i) a source of copper selected from the group consisting of: basic copper nitrate, copper oxide, copper hydroxide, copper complex of guanylurea nitrate, and combinations thereof, (ii) at least one oxidizer, (iii) a binder selected from guanidine nitrate and guanylurea nitrate, and (iv) an optional inorganic fuel comprising an elemental metal or metal hydride comprising a metal selected from the group consisting of: titanium, silicon, aluminum, magnesium, iron, and combinations thereof. Other optional ingredients discussed above may also be present in the mixture or may be introduced in subsequent processing. The mixture may be an aqueous mixture or may be a mixture of solid materials suspended in a carrier. Spray drying such a mixture of (i) a source of copper, (ii) an optional oxidizer, (iii) a binder, and (iv) optional inorganic fuel, as described above, may be accomplished using various spray drying techniques and equipment known to those of skill in the art. For example, suitable spray drying apparatuses and accessory equipment include those manufactured by Anhydro Inc. (Olympia Fields, IL), BUCHI Corporation (New Castle, DE), Marriott Walker Corporation (Birmingham, MI), Niro Inc. (Columbia, MD), and Spray Drying Systems, Inc. (Eldersburg, MD). The spray-dried mixture forms a powder material. In certain aspects, the aqueous mixture includes various other optional ingredients, as well. The powder is then pressed to produce grains of the igniter composition.

The compositions of the present disclosure are thus advantageous in that they may be spray dried in normal production equipment, either with all components outlined above as a final composition, or as a fuel-deficient precursor to which the desired inorganic fuel(s) are later incorporated by dry blending. The response to ignition at ambient pressures is relatively mild, more similar to the ignition properties of a gas generant rather than a conventional igniter composition, so that it is not necessary to restrict the quantity of material that may be processed and handled. This is particularly true when employing the spray dry precursor method. In this case, the precursor exhibits a combustion energy as determined by heat of explosion (HEX) of less than 1000 cal/g, which as noted above is considered to be a maximum HEX amount permitted during normal production spray dry operations due to safety considerations.

Therefore, in certain aspects, the (iv) one or more inorganic fuels may be introduced to the igniter composition prior to or during spray drying as discussed above, or in alternate aspects, after the igniter powder has been formed via dry blending or mixing of the fuel-deficient precursor or powder with solid fuels. In such embodiments where the (iv)

one of more inorganic fuels are withheld during spray drying, a mixture includes (i) a source of copper selected from the group consisting of: basic copper nitrate, copper oxide, copper hydroxide, copper complex of guanylurea nitrate, and combinations thereof, (ii) at least one oxidizer, (iii) a binder selected from guanidine nitrate and guanylurea nitrate, along with other optional ingredients that are spray dried to form a powder material. Then, the powder material is mixed with (iv) an optional inorganic fuel comprising an elemental metal or metal hydride comprising a metal selected from the group consisting of: titanium, silicon, aluminum, magnesium, iron, and combinations thereof (e.g., dry blended). The mixture of fuel deficient spray-dried powder and inorganic fuel is then pressed to produce grains of the igniter material for the initiator.

The ability to process the igniter composition safely in relatively large amounts can significantly reduce the cost of the compositions prepared in accordance with certain aspects of the present disclosure compared to current, boron-based ignition booster materials.

The spray drying process is used for forming particles and dry materials. It is suited to continuous production of dry solids in powder, granulate, or agglomerate particle forms using liquid feedstocks to make the igniter material. Spray drying a mixture of (i) a source of copper, (ii) an optional oxidizer, (iii) a binder, and (iv) an optional inorganic fuel, as described above, may be accomplished using various spray drying techniques and equipment known to those of skill in the art. Spray drying can be applied to liquid solutions, dispersions, emulsions, slurries, and pumpable suspensions. Variations in spray drying parameters may be used to tailor the dried end-product to precise quality standards and physical characteristics. These standards and characteristics include particle size distribution, residual moisture content, bulk density, and particle morphology.

The igniter composition may be formed from an aqueous dispersion of one or more components that are added to an aqueous vehicle to be substantially dissolved or suspended (for example, dispersed and stabilized) as a stable dispersion of solid particles. Thus, the solution or dispersion may be in the form of a slurry. The dispersion or slurry may be spray-dried by passing the liquid mixture through a spray nozzle in order to form a stream of droplets. The droplets may contact hot air to effectively remove water and any other solvents from the droplets and subsequently produce solid particles of the igniter composition.

The mixture of components forming the aqueous dispersion may also take the form of a slurry, where the slurry is a flowable or pumpable mixture of fine (relatively small particle size) and substantially insoluble particle solids suspended in a liquid vehicle or carrier. Mixtures of solid materials suspended in a carrier are also contemplated. Thus, the slurry contains flowable and/or pumpable suspended solids and other materials in a carrier.

Suitable carriers include aqueous solutions that may be mostly water; however, the carrier may also contain one or more organic solvents or alcohols. In some embodiments, the carrier may include an azeotrope, which refers to a mixture of two or more liquids, such as water and certain alcohols that desirably evaporate in constant stoichiometric proportion at specific temperatures and pressures. The carrier is selected for compatibility with the fuel and oxidizer components to avoid adverse reactions and further to maximize solubility of the several components forming the slurry. Non-limiting examples of suitable carriers include water, isopropyl alcohol, n-propyl alcohol, and combinations thereof.

Viscosity of the slurry is such that it can be injected or pumped during the spray drying process. In some embodiments, the slurry has a water content of greater than or equal to about 15% by weight and may be greater than or equal to about 30 wt. %, optionally about 40 wt. %, or optionally about 50 wt. %. In some embodiments, the water content of the slurry ranges from about 15% to 85% by weight. As the water content increases, the viscosity of the slurry decreases, thus pumping and handling become easier. In some embodiments, the slurry has a viscosity ranging from about 50,000 to 250,000 centipoise. Such viscosities are believed to be desirable to provide suitable rheological properties that allow the slurry to flow under applied pressure, but also permit the slurry to remain stable.

Particles produced from the spray-dried droplets may comprise aggregates of fine, well mixed particles of the igniter components, having a primary average particle size of about 0.5 μm to about 200 μm.

In various aspects, the present methods may be used to produce a high burning rate igniter composition, including (i) a source of copper, (ii) an optional oxidizer, (iii) a binder, and (iv) an optional inorganic fuel, as described above. The (i) source of copper (e.g., basic copper nitrate), (ii) optional oxidizer (e.g., potassium perchlorate, potassium nitrate, and/or strontium nitrate), and binder (e.g., guanidine nitrate) may form an aqueous mixture. First, the binder (e.g., guanidine nitrate) may be fully dissolved in the aqueous medium and then adding the source of copper (e.g., basic copper nitrate) and oxidizer (e.g., potassium perchlorate or potassium nitrate) are added to the aqueous mixture to produce a slurry. As noted previously, the inorganic fuel(s) may optionally be mixed in the mixture and thus spray dried with the mixture or can be withheld during spray drying and later dry blended after the spray-dried powder is created with the other components to form the igniter material. After spray drying the slurry, the resulting powder is optionally pressed into tablets, grains, pellets, cylinders, or other geometries to produce solid bodies suitable for use as igniter or booster compositions for use in in an initiator or squib of an inflatable restraint system, for example, an air bag module.

Igniter materials can be formed into a compressed monolithic grain or pellet, which can have an actual density that is greater than or equal to about 90% of the maximum theoretical density. The actual density of the igniter material is optionally greater than or equal to about 93%, optionally greater than about 95% of the theoretical maximum density, optionally greater than about 96% of the theoretical maximum density, and in certain variations, optionally greater than about 97% of the theoretical maximum density when compressed into a grain or tablet.

The igniter materials are in a dry powderized and/or pulverized particulate form. The dry powders may be compressed with applied forces greater than or equal to about 50,000 psi (approximately 350 MPa), optionally greater than or equal to about 60,000 psi (approximately 400 MPa), optionally greater than or equal to about 65,000 psi (approximately 450 MPa), optionally greater than or equal to about 70,000 psi (approximately 483 MPa), and optionally greater than or equal to about 74,000 psi (approximately 500 MPa). In certain aspects, the applied forces may be greater than or equal to about 60,000 psi (approximately 400 MPa) to less than or equal to about 70,000 psi (approximately 483 MPa). The powderized materials can be placed in a die or mold, where the applied force compresses the materials to form a desired grain or pellet shape.

Further, a loading density of the igniter material may be relatively high in a tableted or grain form. A loading density is an actual volume of igniter material divided by the total volume available for the shape. In accordance with various aspects of the present disclosure, a loading density for the igniter shape may be greater than or equal to about 60%.

As noted above, in certain aspects, the hot burning inorganic fuel(s) can be added to the igniter powders after the fuel deficient igniter powder is formed, for example, by spray drying. Similarly, any hot burning organic fuel(s) included in alternative variations may also be added to the fuel deficient igniter powder. The fuel(s) may be dry blended or mixed with the powder prior to pressing or compaction.

Dried particles or powder may be readily pressed into pellets or grains for use in an initiator charge in inflatable restraints; e.g., air bags. The pressing operation may be facilitated by mixing the spray-dried igniter particles with a quantity of water or other pressing aid, such as graphite powder, calcium stearate, magnesium stearate and/or graphitic boron nitride, by way of non-limiting example. The composition may then be pressed into various forms, such as pellets or grains. In certain embodiments, suitable igniter grain densities are greater than or equal to about 1.8 g/cm$^3$ to less than or equal to about 2.2 g/cm$^3$.

In some embodiments, methods of making an igniter material use a processing vessel, such as a mix tank, in order to prepare the igniter formulation that is subsequently processed by spray drying. For example, the processing vessel may be charged with water, guanidine nitrate, basic copper nitrate and oxidizers, like potassium perchlorate or potassium nitrate, which are mixed to form an aqueous dispersion. Additives and components, such as additional inorganic or organic fuel components, other oxidizer components, slagging aids, and the like may be added to the reaction mixture, as well. The resulting aqueous dispersion is then pumped to the spray drier to form the dry powder or particulate igniter product. Further processing steps such as blending, pressing, igniter coating, and the like can then be performed per standard procedures.

Various embodiments of the inventive technology can be further understood by the specific examples contained herein. Specific Examples are provided for illustrative purposes of how to make and use the compositions, devices, and methods according to the present teachings.

Example 1

A precursor powder is formed as follows. Water is heated to 88° C. Then, 22.0 Kg of guanidine nitrate (binder) and 5.67 Kg of potassium nitrate (oxidizer) are added to 61 Kg of the heated water. The mixture is circulated at 88° C. until the solids dissolve. To the resulting solution, 14.17 Kg of potassium perchlorate (oxidizer) and 8.05 Kg basic copper nitrate (bCN—source of copper) are added. The resulting slurry is maintained, with circulation, at a temperature of 88° C. (+/−5° C.) for 60 minutes.

The resulting slurry is then spry dried to produce a turquoise blue powder with the compositions listed in Table 1.

TABLE 1

| Component | Weight % |
|---|---|
| $KNO_3$ | 11.4% |
| $KClO_4$ | 28.4% |
| Guanidine nitrate | 44.1% |
| bCN | 16.1% |

Examples 2-6

The following examples are prepared by blending an inorganic hot burning fuel with a precursor powder prepared as described in Table 1 of Example 1 or similar to the process in Example 1 above. In addition, other components may be included as necessary such as pressing aids, anti-caking agents and the like.

TABLE 2

| Component | Function | Example 2 (wt. %) | Example 3 (wt. %) | Example 4 (wt. %) | Example 5 (wt. %) | Example 6 (wt. %) |
|---|---|---|---|---|---|---|
| KP | First Oxidizer | 25 | 25 | 25 | 25.56 | 25.56 |
| $KNO_3$ | Second oxidizer | 10 | 10 | 10 | 10.22 | 10.22 |
| Guanidine nitrate | Binder, fuel | 38.8 | 38.8 | 38.8 | 39.68 | 39.68 |
| bCN | Co-oxidizer and copper source | 14.2 | 14.2 | 14.2 | 4.53 | 14.53 |
| Silicon | Hot inorganic fuel | — | — | — | — | 7 |
| $TiH_2$ | Hot inorganic fuel | 12 | 10 | 8 | 7 | — |
| Boron | Hot inorganic fuel | — | 2 | 4 | 3 | 3 |

The calculated and measured properties of the compositions of Examples 2 through 6 are shown in Table 3 below.

TABLE 3

| Example | 2 | 3 | 4 | 5 | 6 |
|---|---|---|---|---|---|
| Density, g/cc | 2.06 | 2.055 | 2.42 | 2.027 | 1.978 |
| Combustion temp, K | 2708 | 2759 | 2743 | 2742 | 3056 |
| Gas yield, mole/100 g | 2.559 | 2.621 | 2.675 | 2.664 | 2.575 |
| Calculated Heat of Explosion (HEX), J/g | 4761 | 5133 | 5517 | 5239 | 5490 |
| Burning rate at 20.7 MPa, mm/s (inches/s at 3,000 psi) | 42.4 (1.67) | 48.0 (1.89) | 51.2 (2.02) | 50.1 (1.97) | 50.1 (1.97) |

Examples 7-9

The following Examples 7 through 9 are prepared by blending an inorganic hot burning fuel comprising $TiH_2$ or Boron or a mixture thereof with the precursor powder prepared as described in Table 1 of Example 1 or similar to the process in Example 1 above. Comparative Example 1 is prepared in a similar manner, but contains no titanium hydride, rather only boron as the hot burning inorganic fuel. Safety properties as indicated by impact sensitivity, friction sensitivity, ESD sensitivity or open air linear burning rate are provided in Table 4 showing a comparison of safety properties for the compositions. The open-air linear burning rate test is a more discriminating test in as much as it provides a measure of the bulk hazard of the material resulting from inadvertent ignition.

TABLE 4

| Component | Function | Example 7 | Example 8 | Example 9 | Comparative Example 1 |
|---|---|---|---|---|---|
| KP (wt. %) | Oxidizer | 25 | 25 | 25 | 25 |
| $KNO_3$ (wt. %) | Co-oxidizer | 10 | 10 | 10 | 10 |
| Guanidine nitrate (wt. %) | Binder, fuel | 38.8 | 38.8 | 38.8 | 38.8 |
| bCN (wt. %) | Co-oxidizer | 14.2 | 14.2 | 14.2 | 14.2 |
| $TiH_2$(wt. %) | Hot burning inorganic fuel | 12 | 8 | 4 | — |
| Boron (wt. %) | Hot burning inorganic fuel | — | 4 | 8 | 12 |
| Impact, in | | 17.6 | 3.5 | 4.1 | 3.6 |
| Friction, N | | >120 | >120 | >120 | >120 |
| ESD, J | | >1 | >1 | >1 | >1 |
| Linear burn rate, mm/s | | No propagation | 3.2 | 3.2 | 7.2 |

The results indicate that addition of boron in any amount increases the sensitivity of the composition to impact (where a larger number reflects a less sensitive composition) and promotes ambient pressure bulk propagation burning. However, the open air linear burn rates in Examples 8 and 9 (for igniter compositions including boron) are relatively low compared to Comparative Example 1's open air linear burn rate.

Comparative Examples 2-3

Table 5 provides comparative safety data similarly measured for conventional boron/potassium nitrate based igniter materials.

TABLE 5

| Component | Purpose | Comparative Example 2 | Comparative Example 3 |
|---|---|---|---|
| $KNO_3$ (wt. %) | Oxidizer | 58 | 74 |
| Binder/co-fuel (wt. %) | Binder, fuel | 24 (guanidine nitrate) | 5 (polymeric binder) |
| Boron (wt. %) | fuel | 18 | 21 |
| Impact, in | | 5 to 7 | 5 to 8 |
| Friction, N | | >120 | >120 |
| ESD, J | | >1 | >1 |
| Linear burn rate, mm/s | | 80 | >400 |

As the data in Tables 4 and 5 show, the impact, friction and ESD sensitivity of the inventive compositions (Examples 7-9) are similar to those exhibited by conventional Boron/$KNO_3$ based igniter formulations of Comparative Examples 1-3. Furthermore, Example 7 contains no boron and shows significantly improved impact resistance and no linear burn rate, reflecting a considerably less sensitive igniter composition. The data displayed in Table 5 further reveal that the compositions prepared in accordance with certain aspects of the present disclosure (Examples 7-9) are at least one or two orders of magnitude slower in open air burn propagation rate than the conventional compositions of Comparative Examples 2-3. This represents a significantly reduced safety hazard when manufacturing or handling the igniter compositions prepared in accordance with certain aspects of the present disclosure.

Examples 11-13

In yet other alternative variations, Examples 11 through 13 prepared in accordance with certain aspects of the present disclosure are formed by incorporating an organic hot burning fuel dicyandiamide (DCDA) as an additional ingredient in the aqueous slurry and spray drying to form a precursor powder in a process similar to the process described in Example 1 above. This is followed by blending of an inorganic hot burning fuel comprising $TiH_2$ with the precursor powder. Table 6 provides details of Examples 11-13, which are all free of boron.

TABLE 6

| Component | Function | Example 11 (wt. %) | Example 12 (wt. %) | Example 13 (wt. %) |
|---|---|---|---|---|
| KP | First Oxidizer | 31.82 | 31.85 | 31 |
| $SrNO_3$ | Second oxidizer | 24.46 | — | — |
| $KNO_3$ | Second oxidizer | — | 22.85 | 15 |
| Guanidine nitrate | Binder, fuel | 14.67 | 15.2 | 27 |
| DCDA | Hot organic fuel | 9.27 | 9.3 | — |
| CuGUN | Copper source | 9.78 | 10.8 | 15 |
| $TiH_2$ | Hot inorganic fuel | 10 | 10 | 12 |
| Flame Temperature (K) | | 2864 | 2613 | 2746 |

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An igniter composition comprising:

(v) a source of copper including at least one of copper hydroxide and a copper complex of guanylurea nitrate;

(vi) a plurality of oxidizers that include at least potassium perchlorate ($KClO_4$) and potassium nitrate ($KNO_3$);

(vii) a binder selected from the group consisting of: guanidine nitrate, guanylurea nitrate, and combinations thereof; and (viii) an inorganic fuel comprising at least titanium hydride, wherein the inorganic fuel is present at greater than or equal to about 12% to less than or equal to about 15% by weight of the total igniter composition, and wherein the potassium perchlorate ($KClO_4$) is present at an amount that is greater than or equal to about 5% to less than or equal to about 40% by weight of the total igniter composition, and the potassium nitrate ($KNO_3$) is present at an amount that is greater than or equal to 11.4% by weight to less than or equal to about 40% by weight of the total igniter composition.

2. The igniter composition of claim 1, wherein the inorganic fuel further comprises at least one elemental metal selected from the group consisting of titanium, silicon, aluminum, and combinations thereof.

3. The igniter composition of claim 1 that is substantially free of boron.

4. The igniter composition of claim 1, further comprising less than or equal to about 3 weight % of boron or a compound comprising boron.

5. The igniter composition of claim 1, further comprising at least one organic fuel comprising dicyandiamide (DCDA).

6. The igniter composition of claim 1, wherein the igniter composition has a minimum flame temperature at combustion ($T_c$) of greater than or equal to about 2300K (2,027° C.).

7. The igniter composition of claim 1, wherein:

(i) the source of copper is present at greater than or equal to about 2% to less than or equal to about 20% by weight of the total igniter composition;

(ii) a total amount of the plurality of oxidizers is greater than or equal to about 20% to less than or equal to about 60% by weight of the total igniter composition; and (iii) the binder is present at greater than or equal to about 14% to less than or equal to about 60% by weight of the total igniter composition.

8. The igniter composition of claim 1, wherein:

(i) the source of copper is present at greater than or equal to about 4% to less than or equal to about 17% by weight of the total igniter composition; and (vi) the binder is present at greater than or equal to about 14% to less than or equal to about 40% by weight of the total igniter composition.

9. The igniter composition of claim 1, wherein the plurality of oxidizers includes, in addition to the potassium perchlorate ($KClO_4$) and potassium nitrate ($KNO_3$), at least one selected from the group consisting of: alkali metal or alkaline earth metal nitrates, alkali metal, alkaline earth metal, or ammonium perchlorates, and combinations thereof and a total amount of the plurality of oxidizers present in the igniter composition is greater than or equal to about 20% to less than or equal to about 60% by weight of the total igniter composition.

10. An igniter composition comprising:

(v) a source of copper including at least one of copper hydroxide and a copper complex of guanylurea nitrate present at greater than or equal to about 4% to less than or equal to about 17% by weight of the total igniter composition;

(vi) a plurality of oxidizers including at least the potassium perchlorate ($KClO_4$) and potassium nitrate ($KNO_3$), wherein a total amount of the plurality of oxidizers is greater than or equal to about 20% to less than or equal to about 60% by weight of the total igniter composition;

(vii) guanidine nitrate present at greater than or equal to about 14% to less than or equal to about 60% by weight of the total igniter composition; and (viii) an inorganic fuel present at greater than or equal to about 12% to less than or equal to about 15% by weight of the total igniter composition, wherein the inorganic fuel comprises at least titanium hydride; and wherein the potassium perchlorate ($KClO_4$) is present at an amount that is greater than or equal to about 5% to less than or equal to about 40% by weight of the total igniter composition, and the potassium nitrate ($KNO_3$) is present at an amount that is greater than or equal to 11.4% by weight to less than or equal to about 40% by weight of the total igniter composition.

11. The igniter composition of claim 10 that is substantially free of boron.

12. The igniter composition of claim 10, further comprising less than or equal to about 3 weight % of boron or a compound comprising boron.

13. The igniter composition of claim 10 having a minimum flame temperature at combustion ($T_c$) of greater than or equal to about 2300K (2,027° C.).

14. The igniter composition of claim 1, wherein the source of copper further comprises basic copper nitrate.

15. The igniter composition of claim 1, wherein the source of copper includes the copper complex of guanylurea nitrate.

16. The igniter composition of claim 10, wherein the source of copper further comprises basic copper nitrate.

17. The igniter composition of claim 10, wherein the source of copper includes the copper complex of guanylurea nitrate.

* * * * *